US006817030B2

(12) United States Patent
Desai

(10) Patent No.: US 6,817,030 B2
(45) Date of Patent: Nov. 16, 2004

(54) ARTICLES OF CLOTHING PROVIDING INCREASED AIR CIRCULATION

(76) Inventor: Kishor C. Desai, 2843 Sheriff Way, Winter Park, FL (US) 32792

( * ) Notice: Subject to any disclaimer, the term of this patent is extended or adjusted under 35 U.S.C. 154(b) by 0 days.

(21) Appl. No.: 10/304,027

(22) Filed: Nov. 26, 2002

(65) Prior Publication Data

US 2004/0098784 A1 May 27, 2004

(51) Int. Cl.[7] ..... A41D 7/00; A41D 1/00

(52) U.S. Cl. ..... 2/67; 2/69

(58) Field of Search ..... 2/67, 69, 113, 2/115, 108, 105, 106, 94, 95, 93, 80, 83, 85, 227, 228, 238, 400, 403, 406, 79, 78.1–78.4, 73, 4, 1; 450/1, 54–57, 81, 88

(56) References Cited

U.S. PATENT DOCUMENTS

| | | | | | |
|---|---|---|---|---|---|
| 183,016 | A | * | 10/1876 | Moeller | 2/78.1 |
| 1,571,016 | A | * | 1/1926 | Lesser | 2/227 |
| 1,647,656 | A | * | 11/1927 | Olsen | 2/115 |
| 1,840,937 | A | | 1/1932 | Duff | |
| 1,911,227 | A | | 5/1933 | Galligan et al. | |
| 1,977,329 | A | * | 10/1934 | Tobin | 2/113 |
| 2,249,198 | A | | 7/1941 | Carter | |
| 2,250,506 | A | | 7/1941 | Snyder | |
| 2,610,496 | A | * | 9/1952 | Kostopoulos | 2/113 |
| 3,122,754 | A | * | 3/1964 | Wedin | 2/113 |
| 3,333,589 | A | | 8/1967 | Cohen et al. | |
| 3,479,844 | A | | 11/1969 | Silvain | |
| 3,505,834 | A | * | 4/1970 | Bryson et al. | 2/409 |
| 3,556,106 | A | | 1/1971 | Rosner | |
| 4,476,895 | A | | 10/1984 | Shibusawa | |
| 4,541,129 | A | * | 9/1985 | Murakami | 2/113 |
| 4,557,267 | A | * | 12/1985 | Cole | 450/54 |
| 4,920,769 | A | | 5/1990 | Rickerl | |
| 4,983,140 | A | | 1/1991 | Gimble | |
| 4,996,723 | A | * | 3/1991 | Huhn et al. | 2/105 |

(List continued on next page.)

FOREIGN PATENT DOCUMENTS

| | | |
|---|---|---|
| FR | 2653976 | 5/1991 |
| GB | 2366988 | 3/2002 |

OTHER PUBLICATIONS www.AMericanHOmeHabitat.com–Heavy Duty Fabric and Materials, 22mmpolyester Hex Mesh and 3mm Nylon Hex Mesh, Feb. 6, 2002 Web update. See Web archive.org page with web update date.* www.Somethingsexyplanet.com– Leg Avenue Bodystocking– Ringo Hole Bodystocking– 08/03 with Webarchive web update date information.* www.Somethingsexyplanet.com– Leg avenue Crochet Keyhole Bikini Set– 04/03 with web archive web update page information attached.*

Undergear, Fall '93—p. 34; Item A p. 26, Item D.*

Victoria's Secret—Spring/Summer—1984—p. 25, Item C.*

*Primary Examiner*—Gloria M. Hale

(74) *Attorney, Agent, or Firm*—Richard C. Litman

(57) ABSTRACT

A series of embodiments of articles of apparel formed of a relatively wide gauge net or mesh material, provide increased air circulation adjacent the body of the wearer. The present apparel may be constructed as outerwear or as underwear, as desired. Additional panels of more finely woven, opaque fabric may be installed in critical areas, to provide additional support and/or to serve as modesty panels where such apparel is configured as outerwear. Alternatively, the present apparel may be provided with a removable or permanently installed thin but opaque fabric liner, in any of its embodiments. The present apparel is well suited for wear as underwear and sleep wear in very warm and humid climates, allowing perspiration to evaporate much more readily from the wearer. The installation of modesty panels or liners with the present apparel, allows the apparel to be used as outerwear, including swimwear, athletic or dance attire, etc.

8 Claims, 6 Drawing Sheets

U.S. PATENT DOCUMENTS

| | | | | | |
|---|---|---|---|---|---|
| 5,023,957 | A | | 6/1991 | Harvey | |
| 5,120,264 | A | | 6/1992 | Van Engel | |
| 5,143,092 | A | | 9/1992 | Flowers | |
| 5,214,797 | A | * | 6/1993 | Tisdale | 2/4 |
| 5,237,706 | A | | 8/1993 | Nalbandian | |
| 5,363,511 | A | | 11/1994 | Brewer | |
| 5,528,775 | A | | 6/1996 | Marenda | |
| 5,659,895 | A | * | 8/1997 | Ford, Jr. | 2/2.11 |
| 6,231,488 | B1 | * | 5/2001 | Dicker et al. | 2/69 |
| 6,243,880 | B1 | | 6/2001 | Lyden | |
| 6,263,511 | B1 | | 7/2001 | Moretti | |
| 6,401,250 | B1 | | 6/2002 | McNabb | |
| 2002/0092084 | A1 | | 7/2002 | Takayama | |

* cited by examiner

ARTICLES OF CLOTHING PROVIDING INCREASED AIR CIRCULATION

BACKGROUND OF THE INVENTION

1. Field of the Invention

The present invention relates generally to clothing and apparel, and more specifically to apparel formed of a relatively wide or open mesh net material for wear as outerwear or underwear, depending upon the specific configuration of the apparel. The apparel of the present invention may be formed of stretch or non-stretch material, as desired, and may be colored or shaded to match or contrast with the wearer's body, as desired. The present apparel may include one or more opaque panels or a lining of matching or contrasting color and formed of a more finely woven fabric material, as desired, for greater support in certain areas, and/or to serve as modesty panels where the present apparel is provided in a configuration for wear as an outer garment and is worn as swimwear, athletic wear, or otherwise exposed to public view.

2. Description of the Related Art

It is generally recognized that optimum personal health is best maintained by avoiding temperature extremes, among other factors. This can be difficult in tropical and subtropical areas of the world, and even in more temperate climates during the summer months. One of the major problems in such warm weather, is the evaporation of perspiration during and after exertion. The moisture remaining on the body due to perspiration after exertion, provides an ideal environment for various microorganisms which can lead to odors, skin rashes and other irritations and diseases, etc.

It is of course conventional, where custom permits and the wearer is comfortable with the clothing, to wear relatively few and/or abbreviated garments when exercising, swimming, etc. This results in a minimal amount of fabric to absorb moisture, thereby allowing perspiration or moisture on the wearer's body to evaporate more readily, and minimizing the above noted problems. However, the relatively close weave of the generally opaque fabrics used for such apparel, and the lack of absorbency of stretch synthetic materials which are commonly used in such apparel, generally make it difficult for perspiration and moisture to evaporate from the body of the person wearing such apparel, particularly in those areas covered by the apparel.

This can be uncomfortable at best, and may lead to various undesirable conditions, such as odors, skin rashes, etc., as noted further above. While these conditions may be more readily encountered during heavy exertion and/or in water sports or activities, the difficulty in achieving the evaporation of perspiration may be encountered in other environments as well. This is particularly true in tropical climes where high heat and humidity are common, so that a person wearing conventional street attire cannot rid himself or herself of perspiration buildup due to the lack of evaporation caused by the high humidity.

The present invention responds to this problem by providing a number of different configurations or embodiments of apparel which provide for increased air circulation over the body of the person wearing the apparel. The various embodiments of the present apparel are each formed of a relatively wide or open gauge or mesh net material, in order to provide optimum comfort for the wearer in warm and/or humid environments. The present apparel may be configured for wear as mens' or women's undergarments, with the relatively high exposure provided by the open mesh or net being covered by outer garments as required or desired. The open mesh or net material of the present apparel when configured as undergarments, provides significantly greater air circulation immediately adjacent the body of the wearer, thus promoting the evaporation of perspiration and greater comfort for the wearer.

The present net or mesh garments may also be configured for use as outer wear (e.g., swim and athletic apparel, dance apparel, etc.) as well, if so desired. In such cases, additional opaque panels may be added within the mesh to serve as concealment for critical areas of the body (pubic area, women's breasts, etc.). Such opaque panels may be continuous throughout the entire mesh garment, or may serve to cover and conceal only those critical areas where coverage is required due to convention and community standards. Such additional panels may assist in providing additional support to certain portions of the anatomy, as well, and may be colored in any matching or contrasting colors, as desired.

A discussion of the related art of which the present inventor is aware, and its differences and distinctions from the present invention, is provided below.

U.S. Pat. No. 1,840,937, issued on Jan. 12, 1932 to Ewen C. Duff, titled "Apparel Garment," describes a combination girdle and brassiere garment, with the two components being joined only by a single front panel which extends over the stomach and midriff of the wearer. The front panel is described as being formed of a stretch material, but the weave is sufficiently fine (i.e., "glovesilk," per column 2, line 78 of the disclosure) that it is essentially opaque and does not provide the "breathability" or open mesh configuration of the present invention, to allow good air circulation. In fact, the form retaining characteristics of at least the girdle portion of the Duff garment teach away from any relatively open mesh or net construction, due to the requirement for increased support.

U.S. Pat. No. 1,911,227, issued on May 30, 1933 to James J. Galligan et al., titled "Crinkled Rubber Bathing Suit," describes a womens' swimsuit which is formed of a rubberized material, as the title of the Galligan et al. U.S. Patent indicates. The Galligan et al. material comprises two finely ribbed plies of thin rubber sheet material laminated together. The use of such material teaches away from the present invention, as such rubberized material does not allow the skin beneath the material to breathe, nor does it allow moisture to evaporate from the body where covered by such material.

U.S. Pat. No. 2,249,198, issued on Jul. 15, 1941 to Horace A. Carter, titled "Garment Construction," describes the construction of an undergarment formed of a tubular knit fabric material. The knit material is formed of both elastic and inelastic yarns, with the elastic yarns running in a straight pattern about the fabric and the inelastic yarns being knitted together to provide resilience, as is conventional in such fabrics. The knit weave of the Carter material is relatively fine, as is evidenced from the garment illustrated in FIGS. 1 and 2 of the disclosure. No widely spaced net mesh, nor optional removable or permanent inner liner, are disclosed by Carter in his garment construction.

U.S. Pat. No. 2,250,506, issued on Jul. 29, 1941 to Paul Snyder, titled "Undergarment," describes the construction of a pair of undershorts or briefs. The undergarment appears to be intended as mens' wear, but Snyder does not make this clear in his disclosure. The Snyder undergarment is constructed of a series of relatively finely woven fabric panels, and includes various elastic panels therein to allow the structure to give when the wearer bends and moves. No relatively open mesh or large scale gauge net material is disclosed by Snyder in his undergarment construction, nor is any means of using such an undergarment as outerwear (swimwear, etc.) by means of appropriate modesty panels or inner liners, as provided by various embodiments of the present clothing articles.

U.S. Pat. No. 3,333,589, issued on Aug. 1, 1967 to Albert M. Cohen et al., titled "Swim Garment With Built-In Control Support," describes conventional loose fitting, boxer type swim trunks incorporating a form fitting inner liner permanently installed within the shorts or trunks. Cohen et al. describe the front and back panels of the liner material as being of "power net construction" (col. 2, lines 32–33), but the illustration of this material in FIG. 3 of the Cohen et al. U.S. Patent is of a non-woven latticework pattern, rather than being a woven or knit material. In any event, the Cohen et al. suit construction teaches away from the configuration of the present garments, in that Cohen et al. provide an outer garment formed of a relatively tightly woven fabric material, rather than forming the outer garment of an open mesh or wide gauge net material, as in the present garments.

U.S. Pat. No. 3,479,844, issued on Nov. 25, 1969 to Andre H. Silvain, titled "Form-Fitting Seamless Garment And Method," describes various embodiments of a women's undergarment which may cover substantially the entire torso, or only the area between waist and thighs. The lower portion of the garment is formed of a tightly knit yarn, and is intended to provide control in the manner of a girdle or the like. Silvain does not disclose the use of a widely spaced mesh or net material for his garment construction, and in fact such material would not be suitable for the purposes of the Silvain undergarment, with its function as a control garment or girdle.

U.S. Pat. No. 3,556,106, issued on Jan. 19, 1971 to Leonard A. Rosner, titled "Combination Undergarment," describes an upper brassiere and lower slip or girdle, with the upper and lower garments being joined partially about their mutual circumferences. They are separated from one another at the back, allowing the brassiere portion to be adjusted as desired, and facilitating donning the undergarment. Rosner is silent regarding the specific fabrics used, but the drawings appear to show a conventional finely woven fabric material for all portions of the undergarment. Such material does not provide the ventilation and "breathability" of the widely spaced mesh or net material of which the present articles of clothing are formed.

U.S. Pat. No. 4,476,895, issued on Oct. 16, 1984 to Masaru Shibusawa, titled "Short Girdle," describes a specific construction for a generally panty-configured undergarment formed of closely woven resilient materials which provide control for the wearer. As noted above, this material does not provide the ventilation of a relatively open mesh or net material. No disclosure is made of any form of widely spaced mesh or net material for the construction of the Shibusawa garment.

U.S. Pat. No. 4,920,769, issued on May 1, 1990 to Peter Rickerl, titled "Warp Knitted V-Shaped Briefs," describes the construction of a high-cut pattern or design, particularly for women's underwear. The material used is relatively finely knit, in comparison to the relatively large gauge, open mesh net of which the present garments are formed.

U.S. Pat. No. 4,983,140, issued on Jan. 8, 1991 to Richard Gimble, titled "Backless, Strapless Ladies' Body Briefer," describes a woman's undergarment in which the required rigidity for the garment is provided by a series of bones or stays installed therein. Such construction teaches away from the flaccid, wide mesh net material of which the present garments are constructed.

U.S. Pat. No. 5,023,957, issued on Jun. 18, 1991 to Mary A. Harvey, titled "Panty Hose For Wearing Under An Abbreviated Outer Garment," describes a panty hose combination having a relatively low waistline and narrow crotch, so as to conceal the waistline and crotch beneath a G-string or similar abbreviated garment. The construction of panty hose, wherein the fabric material extends completely down the legs of the wearer, teaches away from the present articles of apparel, which teach that it is desirable to reduce the amount of fabric in contact with the wearer's body in order to provide optimum ventilation and air circulation. The relatively fine mesh weave of the Harvey panty hose material, does not provide this benefit.

U.S. Pat. No. 5,120,264, issued on Jun. 9, 1992 to Pearl E. Van Engel, titled "Women's Bra And Panty Underwear," describes a combination garment which is formed "of denier 30" (col. 2, line27) or "a lightweight denier 10 knit/mesh fabric" (col. 2, line 32). Such yarn is used for nylon stockings and the like, and is much too light to provide the required structural strength of the relatively wide gauge net of which the present garments are constructed.

U.S. Pat. No. 5,143,092, issued on Sep. 1, 1992 to Vivian D. Flowers, titled "Flexible Abdominal Flattener," describes a relatively wide and flat band of material which extends around the waist and hips, with a second similar band of material extending from front to back through the crotch. The material is a woven elastic webbing (per the abstract) which is relatively heavy and thick in comparison to conventional clothing fabrics. Such material does not provide the desired ventilation and air circulation provided by the wide mesh net material of which the present articles of apparel are constructed.

U.S. Pat. No. 5,237,706, issued on Aug. 24, 1993 to Robert M. Nalbandian, titled "Male Garment With Scrotal Pouch," describes a male undergarment which loosely resembles the conventional athletic supporter, but which includes a genitalia pocket defined by two panels. The material of which the Nalbandian undergarment is formed, comprises relatively narrow bands. As such, they must be formed of relatively closely woven material in order to provide the required strength. Nalbandian does not disclose the use of a relatively large gauge or wide mesh material for his undergarment.

U.S. Pat. No. 5,363,511, issued on Nov. 15, 1994 to Christine G. Brewer, titled "Panties And A Method Of Fabricating The Same," describes panty construction wherein the front panel is relatively narrow, and is twisted across the front. The crotch panel extends from the conventional back to join the narrow twisted front panel. Brewer is silent as to the material used, but no wide mesh net material is apparent in the disclosure.

U.S. Pat. No. 5,528,775, issued on Jun. 25, 1996 to Madonna A. Marenda, titled "Women's Abdominal Support Garment," describes an undergarment having an elastic control panel with a waistband disposed over the upper portion of the control panel. This construction, as well as the control panel itself, comprises a laminated composite of two sheets or layers of closely woven fabric material. Such construction teaches away from the wide gauge net material of which the apparel of the present invention is constructed, with its ability to allow greater air circulation and ventilation for the body of the wearer.

U.S. Pat. No. 6,243,880, issued on Jun. 12, 2001 to Robert M. Lyden, titled "Athletic Shorts," describes an undergarment construction for wear by male or female athletes, beneath conventional athletic shorts or the like. While the construction differs between the two types of garments due to the anatomical differences between male and female wearers, the material remains the same for both types, i.e., resilient or non-stretch natural or synthetic fibers, spandex, etc., as described in column 7, lines 11–49. All of the materials of this relatively exhaustive list, comprise relatively fine weaves which do not provide the air circulation and ventilation of the relatively large gauge mesh or net of which the present articles of clothing are constructed.

U.S. Pat. No. 6,263,511, issued on Jul. 24, 2001 to Mario P. Moretti, titled "Breathable Garment To Be Worn To Improve The Comfort Of The Human Body," describes a relatively heavy, multiple layer outer garment which provides thermal insulation for the wearer. While the Moretti garment includes means for air circulation and ventilation, it teaches away from the wide gauge mesh net material of which the present garments are made. The Moretti garment is not suitable for wear in hot and humid conditions, as are the present articles of clothing.

U.S. Pat. No. 6,401,250, issued on Jun. 11, 2002 to Mark J. McNabb, titled "Ventilated Athletic Support Garment," describes a garment formed primarily of spandex material or the like, with a ventilated crotch gusset. The crotch gusset is formed of "an open mesh" (col. 4, line 12), but McNabb continues by stating that "The mesh is formed with between 75 and 125 openings per square inch in the relaxed state," (col. 4, lines 18–19), with a lesser number when the fabric is stretched. Moreover, McNabb states that the fabric material which he uses has "between about 55 and 75 threads per square inch" (col. 4, line 21). This does not at all compare with the ¾ inch to two inch gauge of the net material of which the present garments are formed.

U.S. patent Publication Ser. No. 2002/92,084, published on Jul. 18, 2002, titled "Clothing Waist Portion Structure," describes a multiple ply, absorbent waistband for installation in conventional garments. The material is closely woven, and does not compare with the wide gauge net of the present garments.

French Patent Publication No. 2,653,976, published on May 10, 1991 to Claude Vernay, titled "Undergarment Which Is Unrolled," describes (according to the drawings and English abstract) a device for assisting in fitting an undergarment, by unrolling the undergarment from a rolled state. A separate strip surrounds the top of the body, to which a three piece article (slip, pant, etc.) is attached. No disclosure is made of any specific type of fabric material for the assembly, and no wide gauge net or mesh material is apparent.

Finally, British Patent Publication No. 2,366,988, published on Mar. 27, 2002 to Paul Brady, titled "Male Undergarment," describes a pair of briefs or shorts having short leg lengths, but also including a frontal pouch for the male genitalia. The external appearance is much like that of the athletic shorts of the Lyden '880 U.S. Patent, discussed further above. As in the case of the Lyden shorts and other shorts, briefs, and garments discussed further above, the undergarment of the Brady '988 British Patent Publication is constructed of a relatively finely woven elastic fabric material. Such material cannot provide the ventilation and air circulation provided by the relatively large gauge mesh or net material of which the present articles of apparel are constructed.

None of the above inventions and patents, taken either singularly or in combination, is seen to describe the instant invention as claimed. Thus articles of clothing providing increased air circulation solving the aforementioned problems are desired.

SUMMARY OF THE INVENTION

The present invention comprises a series of different embodiments of clothing or articles of apparel formed of a relatively wide gauge mesh or net material, and providing increased air circulation adjacent to the body of the wearer. The present clothing is particularly suitable for wear in very warm and humid climates, and allows perspiration to evaporate from the wearer much more readily than conventional clothing.

The present apparel may be constructed as underwear or outerwear for both men and women, as desired. Panels of more finely woven fabric may be installed in certain critical areas (i.e., male genitalia and women's breast areas) for support in the case of underwear, and/or as modesty panels where the present garments are constructed as outerwear (swimsuits, athletic and dance wear, etc.). Alternatively, inner liners of a thin, but opaque, finely woven fabric may be removably or permanently installed within the present garments when worn as outer wear, to provide the coverage required by convention and law in most areas. The liners may be provided in a wide range of different colors, in order to match the skin tones of purchasers or wearers, or to contrast with those skin tones and/or with the color of the net or mesh of the apparel, as desired. Also, different gauges of mesh or net material may be combined in different areas of the same garment, and/or decorative panels or openings having different shapes than the mesh pattern used for the majority of the garment may be formed in the apparel, as desired.

Accordingly, it is a principal object of the invention to provide a series of embodiments of articles of clothing formed of a wide mesh net fabric material, and providing increased air circulation adjacent the body of the wearer.

It is another object of the invention to provide such articles of apparel constructed for both men and women, and which may be adapted or modified for use as underwear or as outerwear.

It is a further object of the invention to provide such clothing to include one or more panels of finely woven opaque fabric material at critical areas thereof, to provide additional support where required and/or to serve as modesty panels where the present apparel is worn as outerwear.

Still another object of the invention is to provide removable or permanently installed liners for the present apparel, with the liners being formed of thin, but opaque, finely woven fabric to provide coverage as required when the present apparel is worn as outerwear.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a series of embodiments of articles of clothing formed of a relatively wide gauge or open mesh net construction, to provide superior ventilation and air circulation adjacent the body of the wearer. The present articles of clothing may be constructed in men's or women's fashions and styles, as single or multiple piece garments, and/or for use as outerwear (e.g., swimwear, athletic wear, etc.), underwear, or sleepwear. A modesty and/or support panel(s) may be removably or permanently installed with the present articles of apparel, where required for public use as outerwear and/or to provide support to certain areas of the body, as needed.

Figure 1:
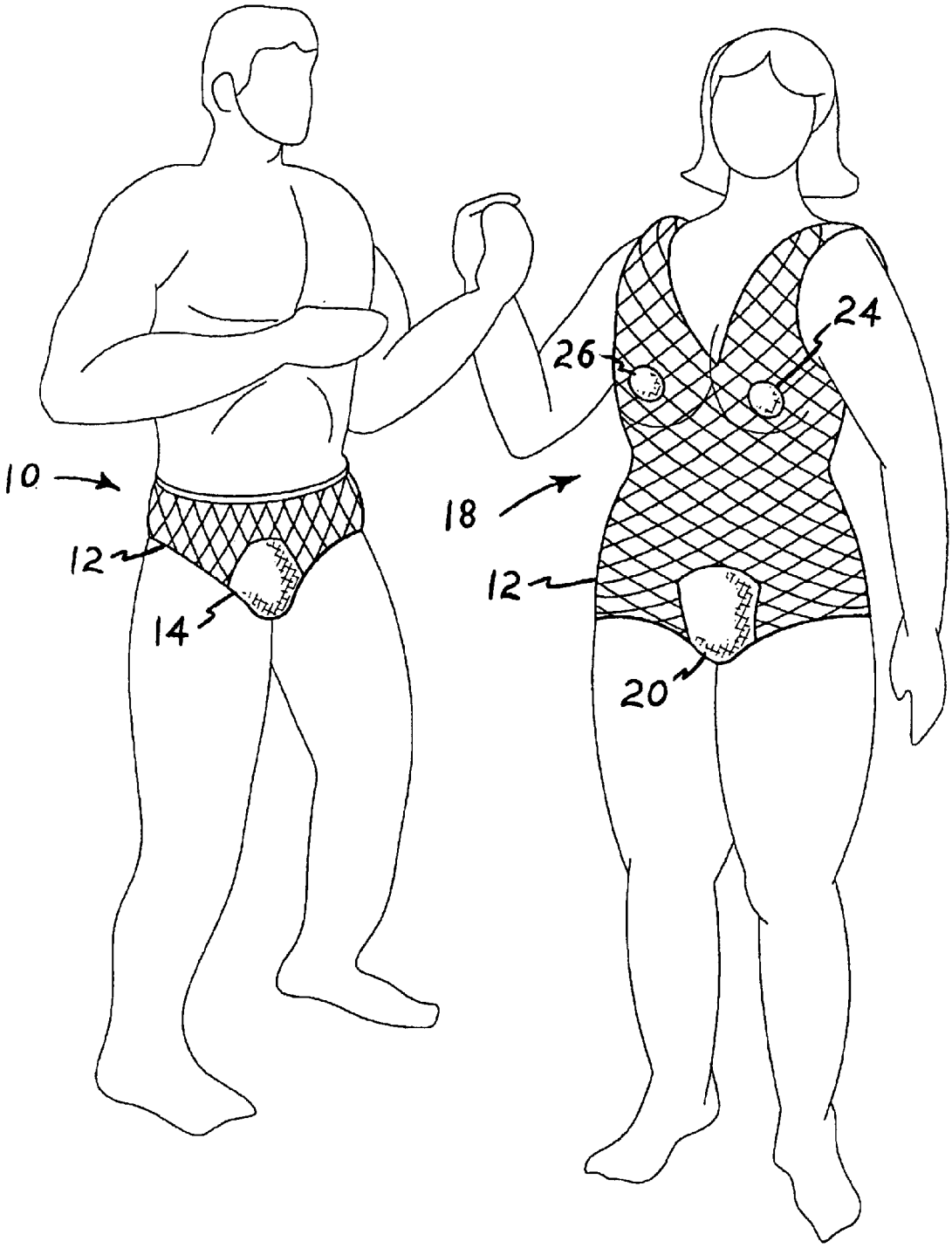
FIG. 1 is a front perspective view of both a man's and a woman's swimwear formed of a wide gauge net material and providing increased air circulation according to the present invention.
Figure 2:
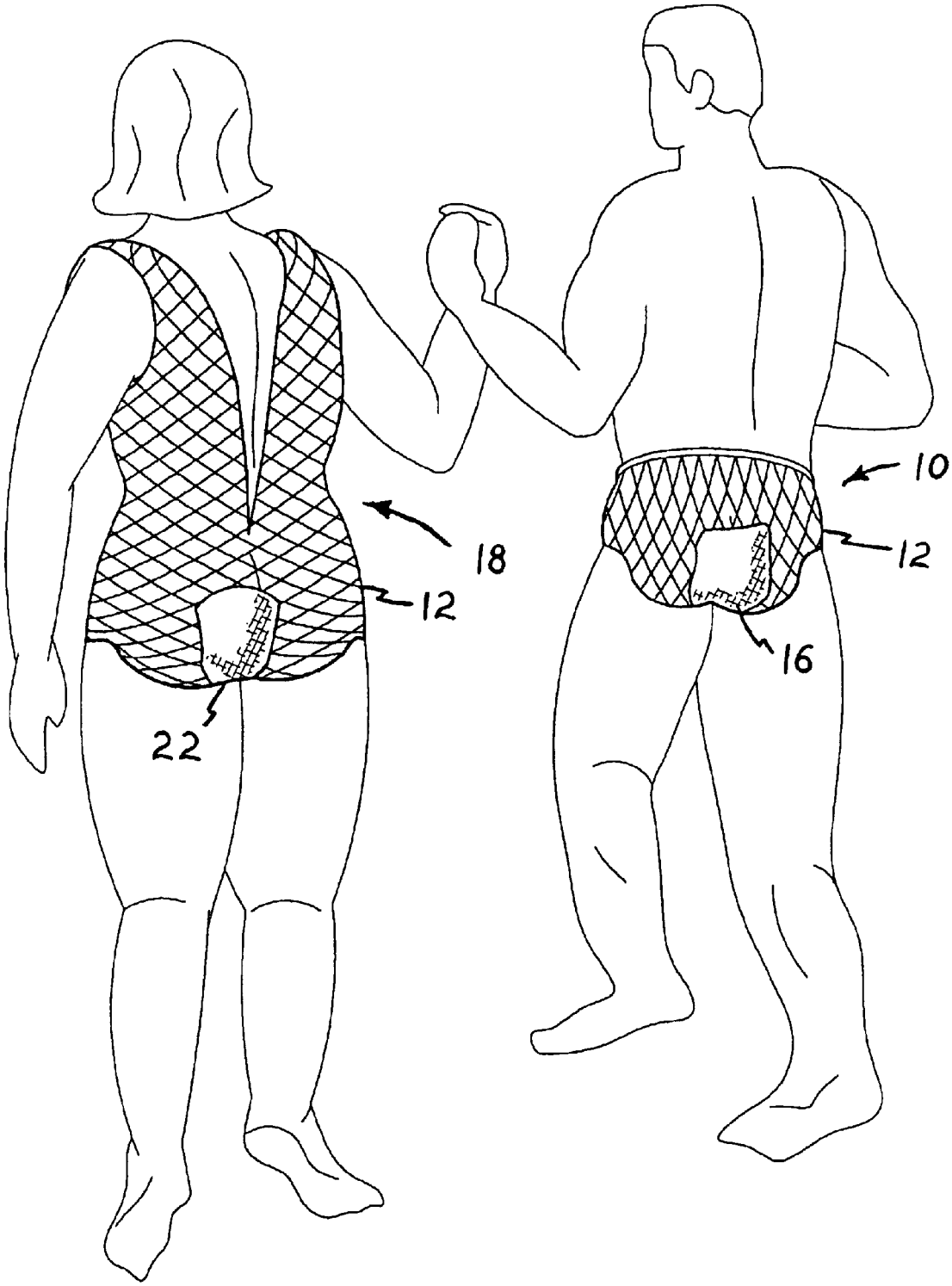
FIG. 2 is a rear perspective view of the man's and woman's swimwear of FIG. 1.

FIGS. 1 and 2 of the drawings respectively provide front and rear perspective views of first embodiments of the present apparel, illustrating its adaption as men's outerwear and women's outerwear. The men's outerwear garment 10 illustrated on the left in FIG. 1 and on the right in FIG. 2, comprises a pair of closely fitting swimming trunks or the like, with the majority of the garment being formed of a relatively wide gauge net or mesh fabric material 12. A number of different fabrics may be used to form any of the embodiments of the present article of apparel, including natural fibers (cotton, etc.) and synthetic fibers (nylon, etc.), and/or a blend of the two. Both non-elastic and elastic (spandex, etc.) materials may be used in the construction of the various embodiments of the present apparel, either exclusively or in combination with one another, as desired.

While various knit fabrics have been used in the past in the construction and fabrication of garments and apparel, the knit materials used have always been of a relatively small or fine gauge or weave, to the knowledge of the present inventor. The present invention departs from this convention, by constructing the various articles of apparel of a relatively wide or open mesh or net material, having an appearance similar to that of a conventional hammock, a tennis net, any other variation of shapes (e.g., squares, rectangles, triangles, diamonds, etc.), or the like. Such net materials have a relatively open mesh or net structure, which provides transparency for all practical purposes. The present articles of apparel have a similar construction, using a gauge having openings on the order of between three quarters of an inch minimum and two inches maximum, between adjacent parallel strands or cords.

This considerably wider or greater gauge of the net or mesh material of the present invention than has been used in prior art garments in the past provides numerous advantages in comfort for the wearer thereof. In very warm and humid climates, any perspiration or other moisture accumulating on the body, does not readily evaporate when conventional clothing having a relatively tight weave, is worn. While abbreviated swimwear is intended to provide freedom of movement for the wearer and avoid the weight and discomfort associated with wet garments, the relatively closely woven fabrics of which such swimwear is conventionally constructed, still result in the same problem of the difficulty of evaporation of moisture from the suit or swimwear after swimming. This is particularly a problem for women's single piece swimsuits.

The present articles of apparel minimize this problem, by minimizing the fabric material used in the construction of the apparel. Where the present apparel is used as outerwear in public, additional modesty panels, e.g. the front panel 14 of the men's swimming trunks 10 of FIG. 1, may be added to conceal the genital and/or other areas as required according to local standards, custom, and law. These modesty panels 14 may also serve as support panels for certain portions of the body where required or desired, in order to retain more flaccid portions of the anatomy (e.g., men's genitalia and women's breasts) where desired. The modesty and support panel 14 of the men's outerwear 10 of FIG. 1 may comprise a front panel, as shown, with a separate rear panel 16 covering and concealing the perianal area, generally as shown in FIG. 2 of the drawings.

These modesty and support panels 14 and 16 are formed of relatively small panels of a relatively closely woven, opaque fabric material for support and concealment, and may comprise separate panels sewn together at the crotch area, or may be cut from a single sheet of material, as desired. The modesty and support panels 14 and 16 may be sewn into a corresponding open area within the net or mesh 12 of the garment 10, or alternatively the net or mesh 12 may be constructed as a complete garment covering the pubic area when worn, with the modesty and support panels 14 and 16 sewn or otherwise secured either inside or outside the net or mesh material 12, as desired.

The women's outerwear garment 18 of FIGS. 1 and 2 is formed of essentially identical material 12 to that used for the men's swimsuit 10 shown in the same drawing FIGS. The outerwear or swimsuit 18 of FIGS. 1 and 2 comprises a one piece suit, extending upwardly from the upper thighs or hips to above the chest or breasts, and supported at the top by shoulder straps. The women's suit 18 may also include a series of modesty panels formed of essentially the same type of relatively finely woven, opaque fabric material from which the modesty and support panel(s) 14 and/or 16 of the men's suit 10 is or are formed. The women's suit 18 may include a lower front modesty panel 20, a corresponding lower rear panel 22 (FIG. 2) formed with the front panel 20 as a single piece or formed separately and attached thereto, and a pair of breast panels 24 and 26. The breast panels illustrated for the women's swimwear 18 of FIG. 1 are relatively small, and only serve to conceal the nipples of the breasts. These panels 24 and 26 may be enlarged to cover a greater area or a removable liner may be inserted, where the wearer deems it desirable It will be noted that in the two embodiments illustrated in FIGS. 1 and 2, that no specific seams are illustrated. Each of the present articles of apparel may be constructed as a single, continuous net structure, if so desired, with the only seams being along areas where any modesty panels are attached to the net structure. Alternatively, the apparel may be constructed conventionally of front and rear panels sewn together along lateral seams, if so desired.

Figure 3:
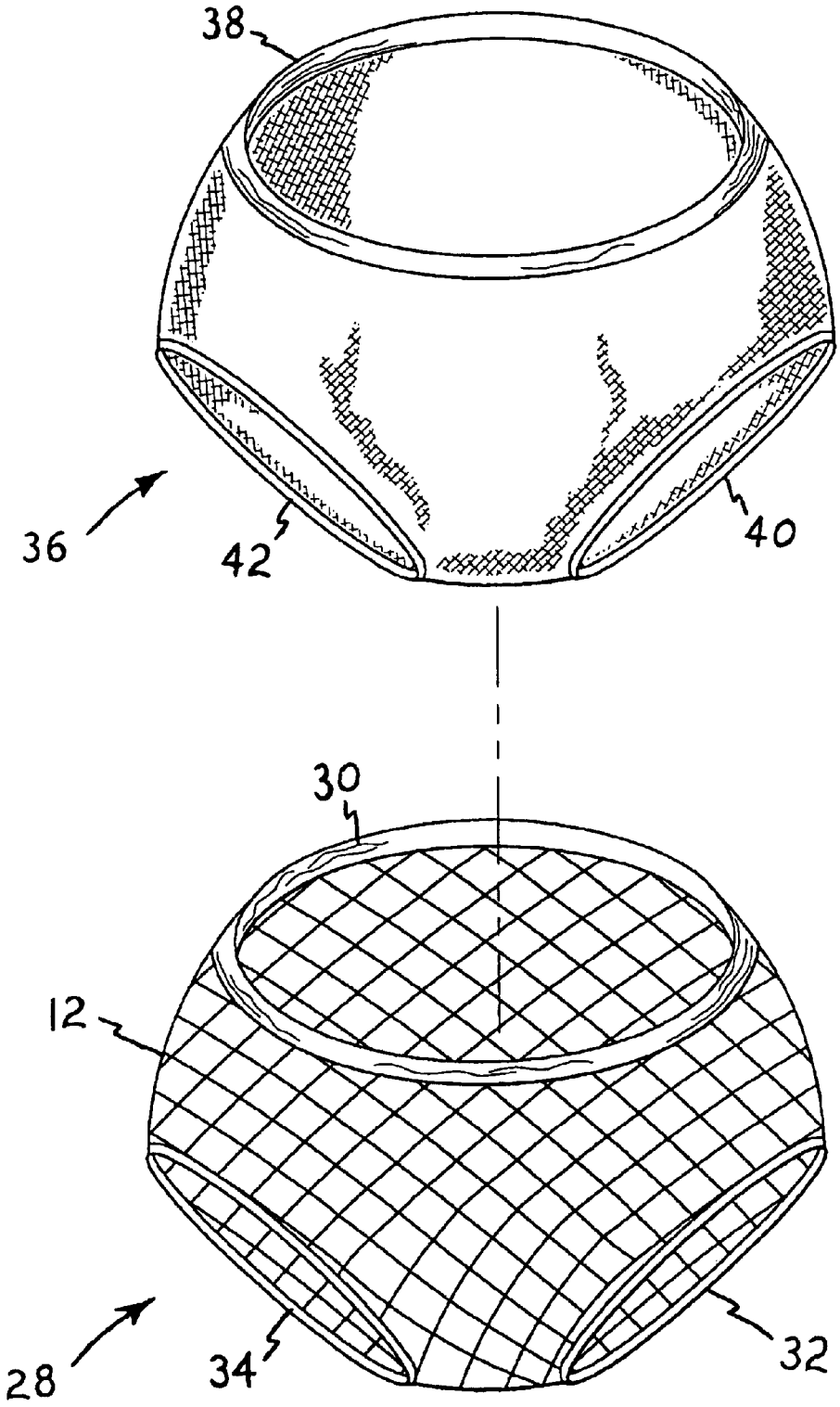
FIG. 3 is an exploded perspective view of another garment embodiment of the present invention, suitable for wear as trunks or pants by a man or woman, showing the addition of a liner thereto.

FIG. 3 provides an exploded view of another embodiment of the present invention, comprising a pair of shorts, trunks, or panties 28. The garment 28 is constructed or formed of the same type of widely spaced mesh or net material 12 as the other embodiments of the present invention, e.g., the swimwear 10 and 18 illustrated in FIGS. 1 and 2. A waistband 30 and leg bands 32 and 34 may be installed about the peripheries of the garment 28, to provide a more conventional fit for the closely fitting garment 28 and to stabilize the open net edges of the material 12 of which the garment 28 is constructed. Similar bands, not specifically indicated, may be installed about the peripheral openings in the swimwear garments 10 and 18 of FIGS. 1 and 2, and other garments constructed according to the present invention, as required.

However, the shorts or panties 28 do not include a smaller modesty or support panel therewith. Rather, an inner liner 36 is provided for use with the garment 28 of FIG. 3. The liner 36 is preferably formed of finely woven, opaque fabric material to provide concealment. The liner 36 is congruent with the garment 28, with a waistband 38 and left and right leg openings 40 and 42, so that it does not extend beyond the waistband 30 and leg openings 32 and 34 of the garment 28. The liner 36 may be installed separately within the garment 28, i.e., donned before donning the garment 28. Alternatively, the liner 36 may be conventionally sewn or otherwise permanently installed within the shorts or panties 28 by securing the waistbands 30, 38, and the respective leg openings 32, 40 and 34, 42 of the two components 28 and 36 together.

The shorts, trunks, or panties 28 of FIG. 3, perhaps with their liner 36, are suitable for wear by both men and women, perhaps with some relatively minor tailoring for fit. However, womens' garments require some form of support and/or coverage for the breasts. The women's garment 44 of FIG. 4 comprises a one piece suit which provides such coverage. The women's garment 44 of FIG. 4 is a one piece suit, extending upwardly from the upper thighs or hips to above the chest or breasts, and supported at the top by shoulder straps, generally along the lines of the women's outerwear or swimsuit 18 of FIGS. 1 and 2.

Figure 4:
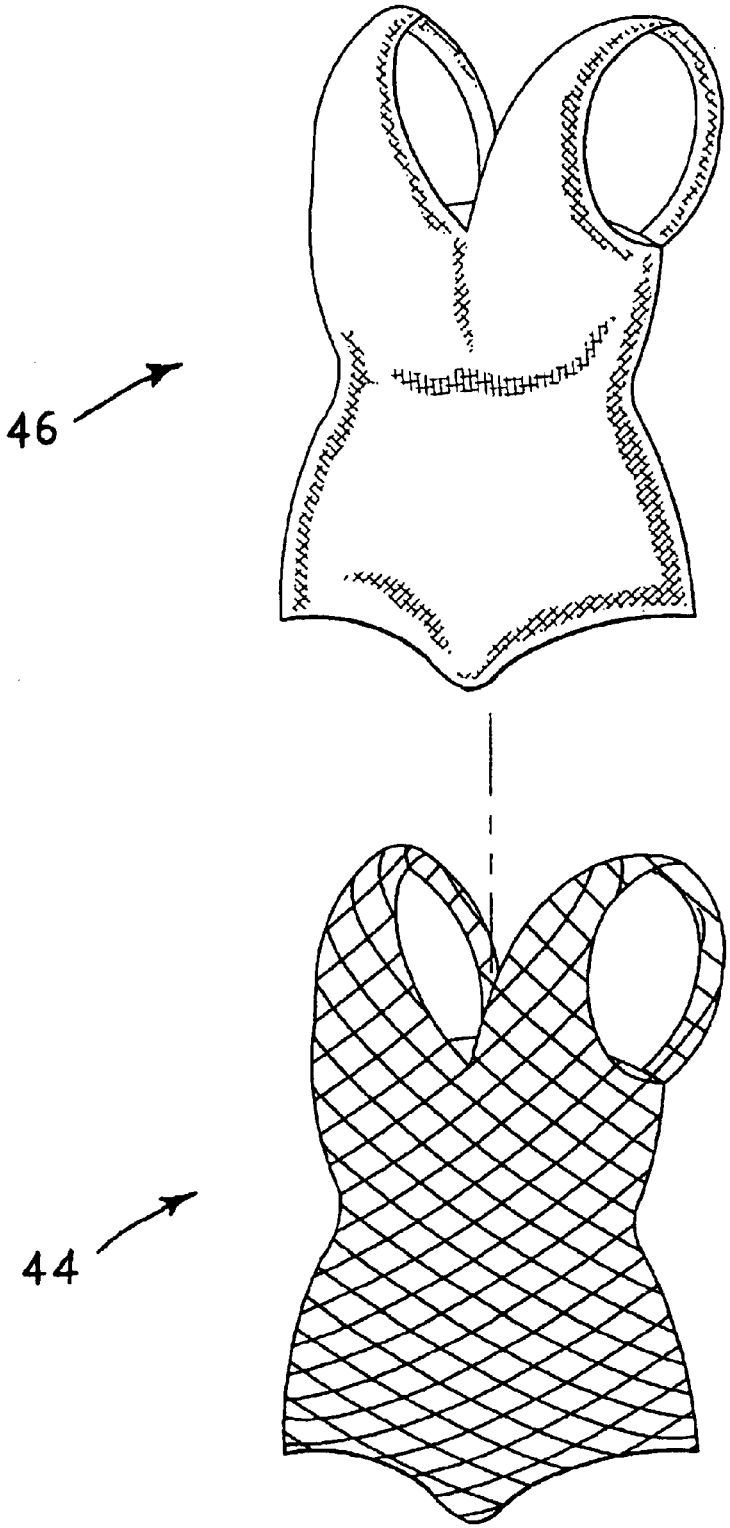
FIG. 4 is an exploded perspective view of a one piece woman's garment, showing the addition of a liner thereto.

However, the garment 44 of FIG. 4 does not include any smaller modesty or support panel(s) therewith, as it is suitable for use as an undergarment, sleepwear, etc., as desired. Rather, an inner liner 46 is provided for the women's garment 44 of FIG. 3. The use of such a liner 46 with the otherwise open mesh of the suit 44, may allow such a garment 44 to be worn as beachwear or other public wear, if desired. The liner 46 may be formed of the same general type of closely woven, opaque material used for the liners and modesty panels of other embodiments. The liner 46 is congruent with the garment 44 in order to fit properly therein, and does not extend beyond the waistband and leg openings of the garment 44. The liner 46 may be installed separately within the garment 44, i.e., donned before donning the garment 44. Alternatively, the liner 46 may be conventionally sewn or otherwise permanently installed within the garment 44 by securing the waistband and respective leg openings of the two components 44 and 46 together.

Figure 5:
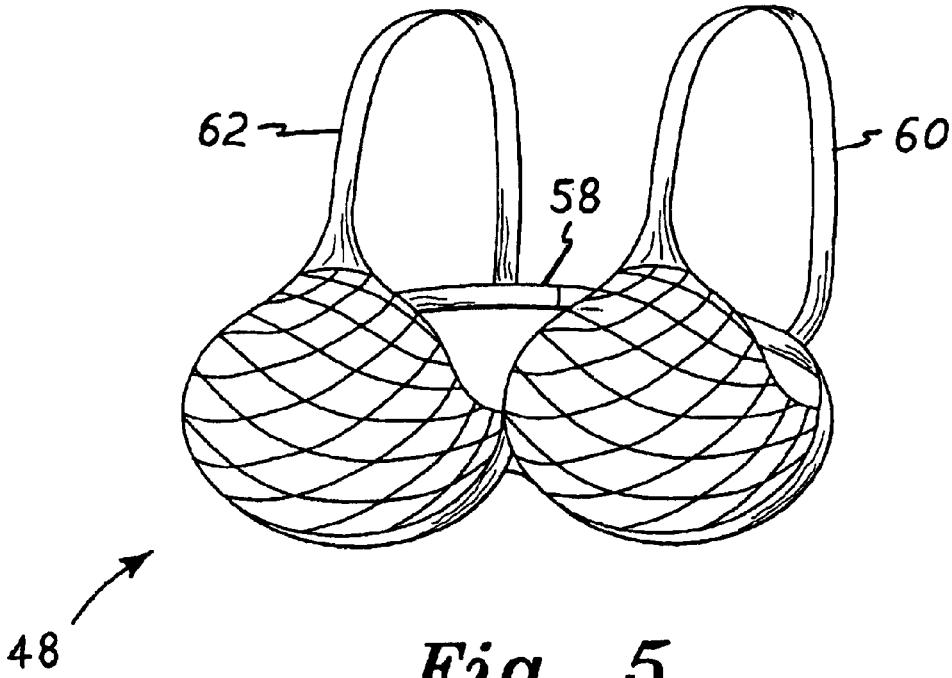
FIG. 5 is a perspective view of an abbreviated top or bra portion of two piece woman's apparel according to the present invention.
Figure 6:
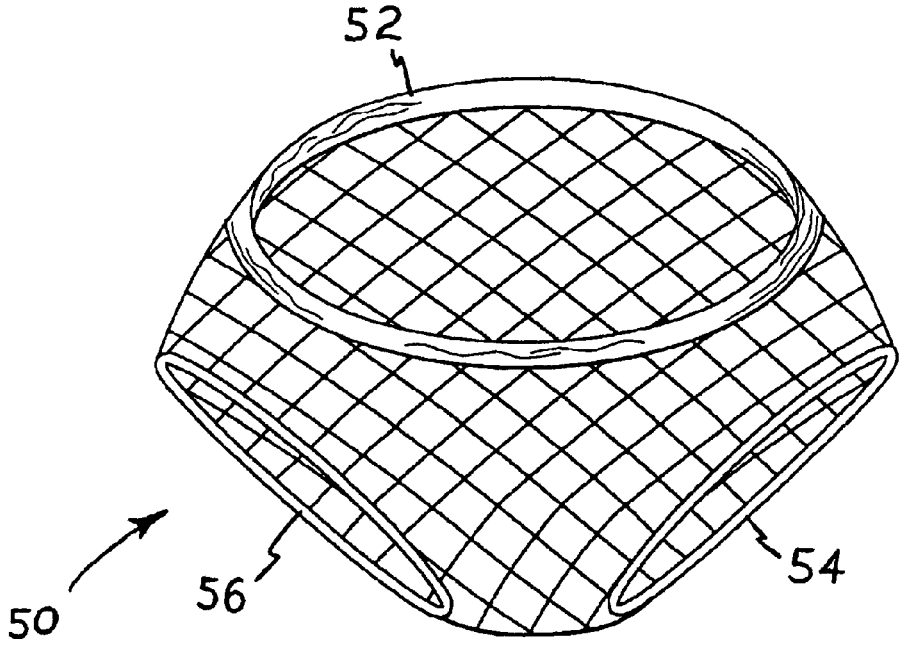
FIG. 6 is a perspective view of an abbreviated bottom or pants portion of two piece woman's apparel according to the present invention.

FIGS. 5 and 6 illustrate a further embodiment of women's wear, comprising a bra portion 48 (FIG. 5) and lower garment 50 (FIG. 6). As in the case of the shorts or trunks 28 of FIG. 3, no modesty and/or support panel(s) is/are integrated with the bra 48 and shorts or panties 50 of FIGS. 5 and 6. However, a liner may be provided for the shorts or panties 50, somewhat on the order of the liner 36 provided for the shorts or panties 28 of the embodiment of FIG. 3. Similar liner material may also be provided for the cups of the bra 48, if so desired. It will be noted that the shorts or panties 50 of FIG. 6 differ somewhat from the comparable garment 28 illustrated in FIG. 3, with the garment 50 of FIG. 6 being cut somewhat lower, i.e., with a shorter distance between the waistband 52 and the two leg openings 54 and 56, as in a "bikini" style garment. The bra portion 48 of FIG. 5 is also minimized, with a relatively thin back strap 58 and shoulder straps 60 and 62.

Figure 7:
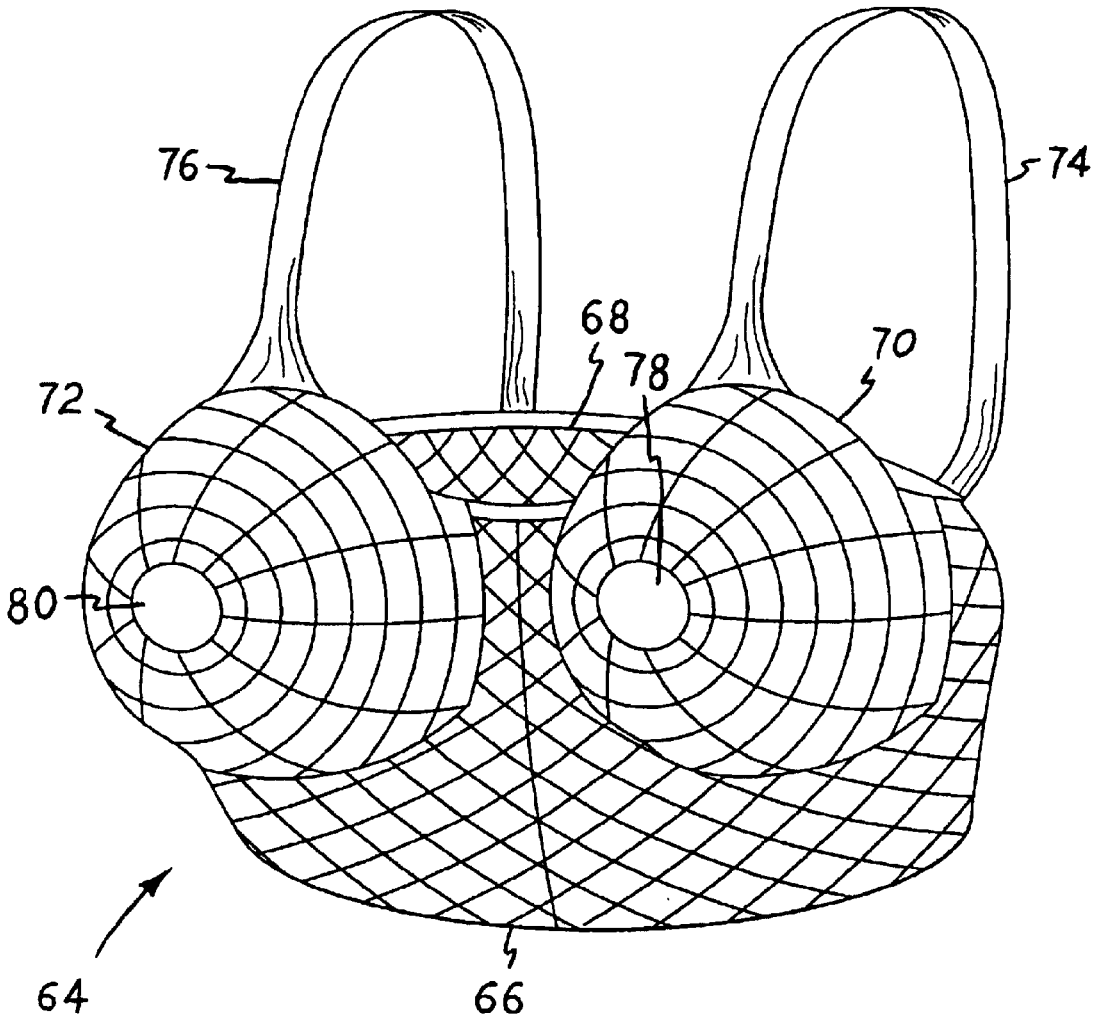
FIG. 7 is a perspective view of a woman's full brassiere embodiment of the present invention.

FIG. 7 illustrates another bra embodiment 64, with the bra 64 of FIG. 7 providing some additional support in comparison to the bra 48 of FIG. 5. The bra 64 of FIG. 7 includes a relatively wide front panel or band 66, which continues about the garment to a wide back panel 68. Both the front and back panels 66 and 68, as well as the cups 70 and 72, are formed of a relatively wide gauge mesh material 12, in keeping with the theme of the present invention disclosed herein. While the shoulder straps 74 and 76 are shown as relatively thin straps, it will be seen that they may also be formed of the same mesh material as the rest of the garment, if so desired.

The bra 64 of FIG. 7 may serve as an undergarment providing relatively good support, for use when jogging or during other relatively strenuous athletic activities. The bra 64 may also serve as a outerwear, with appropriate modesty panels installed. Such modesty panels are shown as relatively small panels 78 and 80, covering and concealing only the nipples of the breasts for the bra 64. However, they may be formed to cover a larger area, if so desired.

In conclusion, the present apparel in its various embodiments, provides greatly increased comfort for the wearer in hot and humid conditions. The wide gauge mesh material of which the present garments are constructed, provides greatly increased open areas to allow for the evaporation of moisture from the body. This is true of undergarments incorporating the net or mesh construction of the present invention, as well, as the thickness of the undergarments holds the outer clothing away from the skin and allows air circulation in the open mesh areas of the undergarments between the outer clothing and skin. Such undergarments may include support panels formed of a relatively tightly woven fabric, to provide greater support of critical areas as required or desired. The present mesh garments are also suited for use as outerwear, where such support panels are formed of an opaque material to serve as modesty panels as well. The present garments will thus find favor among those who desire the utmost in comfort in hot and humid conditions.

It is to be understood that the present invention is not limited to the embodiments described above, but encompasses any and all embodiments within the scope of the following claims.

I claim:

1. An outerwear article of clothing providing increased air circulation for a wearer thereof, comprising:

a closely fitting garment formed of a wide gauge net fabric material; and at least one modesty and support panel formed of a closely woven, opaque fabric material;

wherein said wide gauge net fabric material has a gauge of between three quarters of an inch and two inches, said at least one modesty and support panel being an inner liner having a form substantially contiguous with and selectively removable from said closely fitting garment.

2. The outerwear article of clothing according to claim 1, wherein said wide gauge net fabric material is selected from the materials consisting of a substantially inelastic, natural fiber material, and an elastic, synthetic fiber material.

3. The outerwear article of clothing according to claim 1, wherein said closely fitting garment comprises men's outerwear.

4. The outerwear article of clothing according to claim 1, wherein said closely fitting garment comprises women's outerwear.

5. An underwear article of clothing providing increased air circulation for a wearer thereof, comprising:

a closely fitting garment made from a wide gauge net fabric material and formed as an undergarment; and at least one modesty and support panel formed of a closely woven, opaque fabric material;

wherein said wide gauge net fabric material has a gauge of between three quarters of an inch and two inches, the modesty and support panel being an inner liner having a form substantially continuous with and selectively removable from said closely fitting garment.

6. The underwear article of clothing according to claim 5, wherein said wide gauge net fabric material is selected from the materials consisting of a substantially inelastic, natural fiber material, and an elastic, synthetic fiber material.

7. The underwear article of clothing according to claim 5, wherein said closely fitting garment comprises women's underwear.

8. The underwear article of clothing according to claim 5, wherein said closely fitting garment comprises women's underwear.

* * * * *